US009350115B2

(12) United States Patent
Liao

(10) Patent No.: US 9,350,115 B2
(45) Date of Patent: May 24, 2016

(54) ELECTRICAL CONNECTOR WITH IMPROVED POSITION HOLE

(71) Applicant: FOXCONN INTERCONNECT TECHNOLOGY LIMITED, Grand Cayman (KY)

(72) Inventor: Fang-Jwu Liao, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/677,920

(22) Filed: Apr. 2, 2015

(65) Prior Publication Data

US 2015/0288100 A1 Oct. 8, 2015

(30) Foreign Application Priority Data

Apr. 2, 2014 (TW) ..... 103205627 U

(51) Int. Cl.

| | |
|---|---|
| ***H01R 12/00*** | (2006.01) |
| ***H01R 13/631*** | (2006.01) |
| ***H01R 12/52*** | (2011.01) |
| ***H01R 12/70*** | (2011.01) |
| *H01R 12/73* | (2011.01) |

(52) U.S. Cl.

CPC ..... *H01R 13/631* (2013.01); *H01R 12/523* (2013.01); *H01R 12/7005* (2013.01); *H01R 12/73* (2013.01)

(58) Field of Classification Search

CPC ..... H01R 13/631; H01R 12/7005; H01R 12/523; H01R 12/73; H01R 13/639; H01R 4/04; H01R 12/57; H01R 12/716

USPC ..... 439/74

See application file for complete search history.

(56) References Cited

U.S. PATENT DOCUMENTS

| | | | | | |
|---|---|---|---|---|---|
| 4,970,624 | A * | 11/1990 | Arneson | H01R 4/04 | 174/259 |
| 5,548,488 | A * | 8/1996 | Hansen | H05K 3/326 | 361/796 |
| 5,692,914 | A * | 12/1997 | Mitani | H01R 13/639 | 439/131 |
| 6,071,129 | A * | 6/2000 | Konno | H01R 12/716 | 439/74 |
| 6,124,552 | A * | 9/2000 | Boe | H05K 7/142 | 174/135 |
| 6,129,575 | A * | 10/2000 | Daoud | G01R 31/04 | 439/426 |
| 6,333,855 | B2 * | 12/2001 | Prabaonnaud | 174/138 G | |
| 6,345,991 | B1 * | 2/2002 | Daoud | H05K 3/326 | 439/282 |
| 7,118,383 | B2 * | 10/2006 | Nagata | H01R 9/096 | 431/581 |
| 7,118,389 | B2 * | 10/2006 | Fork | G01R 1/0466 | 439/74 |
| 8,342,873 | B2 * | 1/2013 | Liao | H01R 12/57 | 439/342 |
| 9,222,007 | B2 * | 12/2015 | Xie | C09J 163/00 | |

FOREIGN PATENT DOCUMENTS

TW M328680 3/2008

* cited by examiner

*Primary Examiner* — Jean F Duverne

(74) *Attorney, Agent, or Firm* — Wei Te Chung; Ming Chieh Chang

(57) ABSTRACT

An electrical connector is provided for electrically connecting a chip module with a position post to a printed circuit board. The connector includes an insulative housing defining a matching surface and a mounting surface opposite each other, and a position hole disposed in the insulative housing; a plurality of terminals loaded in the insulative housing. The position hole has three ribs in an inner surface thereof, the ribs extend from the matching surface toward the mounting surface along a straight line.

14 Claims, 6 Drawing Sheets

ELECTRICAL CONNECTOR WITH IMPROVED POSITION HOLE

BACKGROUND OF THE INVENTION

1. Field of the Invention

The present invention relates to an electrical connector, and more particularly to an electrical connector capable of electrically connecting a chip module to a printed circuit board.

2. Description of Related Arts

U.S. Pat. No. 7,581,963 discloses an electrical connector used for electrically connecting a chip module to a printed circuit board. The electrical connector includes an insulative housing loaded with a plurality of terminals and a position post used for positioning the insulative housing to the printed circuit board. The insulative housing defines a plurality of position holes, each of the position hole has a plurality of ribs extending from a top surface toward the bottom surface. A holding space is constructed by the ribs in the position hole to retain the position post. The ribs can not provide an enough holding force. Therefore, an electrical connector with improved structure is desired.

SUMMARY OF THE INVENTION

An electrical connector is provided for electrically connecting a chip module with a position post to a printed circuit board. The connector comprises an insulative housing defining a matching surface and a mounting surface opposite each other, and a position hole disposed in the insulative housing; a plurality of terminals loaded in the insulative housing. The position hole has three ribs in an inner surface thereof, the ribs extend from the matching surface toward the mounting surface along a straight line.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
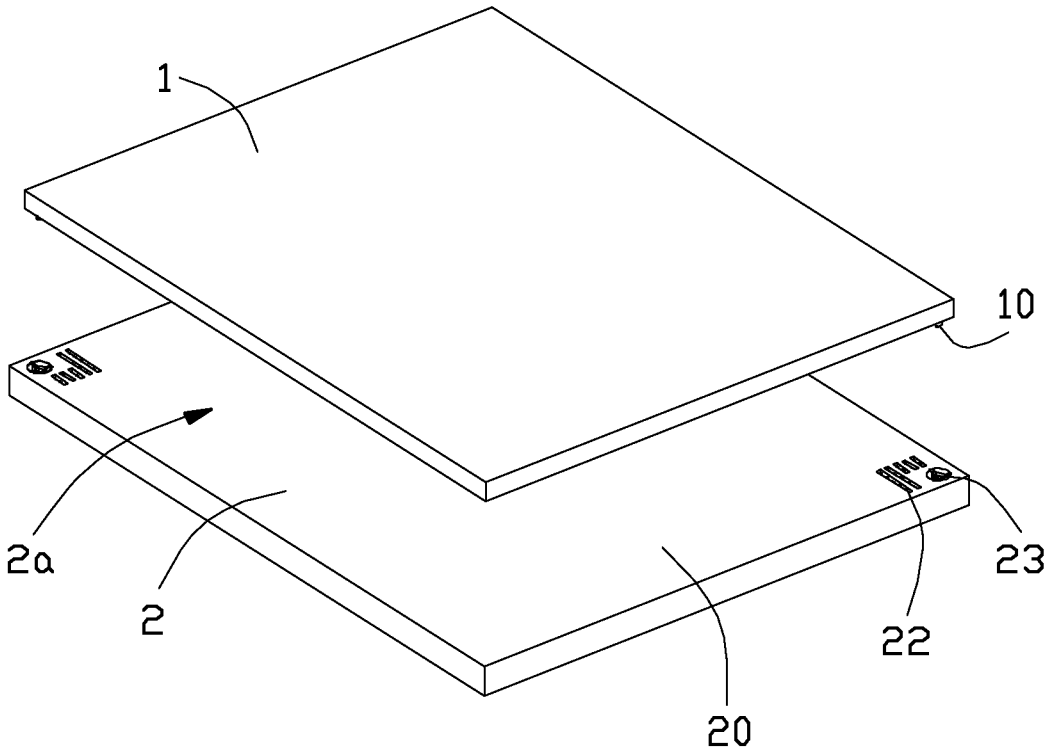
FIG. 1 is a top perspective view of a chip module and an electrical connector disconnecting from each other in accordance with the present invention.

Reference will now be made to the drawing figures to describe the present invention in detail.

Figure 2:
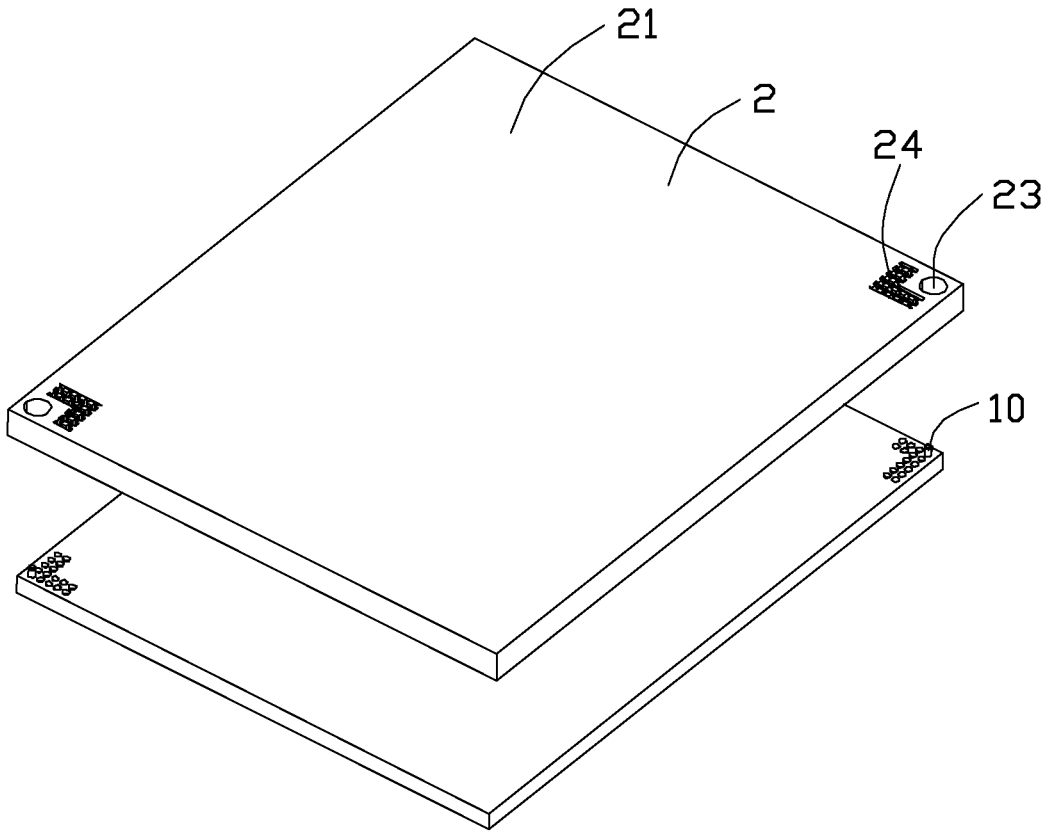
FIG. 2 is a bottom perspective of the chip module and the electrical connector as shown in FIG. 1.
Figure 3:
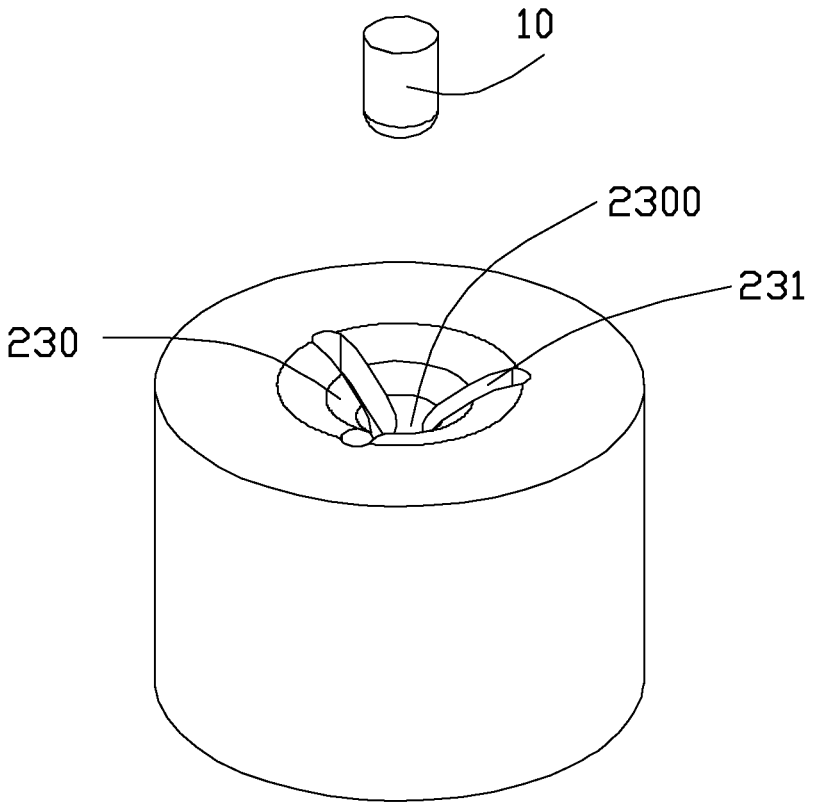
FIG. 3 is a perspective view of a position hole of the electrical connector and a position post of the chip module.

FIGS. 1-2 show an electrical connector 2*a* used for electrically connecting a chip module 1 with a plurality of position posts 10 to a printed circuit board (not shown). The electrical connector 2*a* includes an insulative housing 2 and a plurality of terminals 24 loaded in the insulative housing 2. The insulative housing 2 defines a matching surface 20 and a mounting surface 21 confronting with the printed circuit board, a plurality of terminal holes 22 penetrated from the matching surface 20 to the mounting surface 21 and at least two position holes 23 located at the corners of the insulative housing 2. The plurality of terminals 24 are received in the terminal holes 22. The position holes 23 run through the matching surface and the mounting surface.

Figure 4:
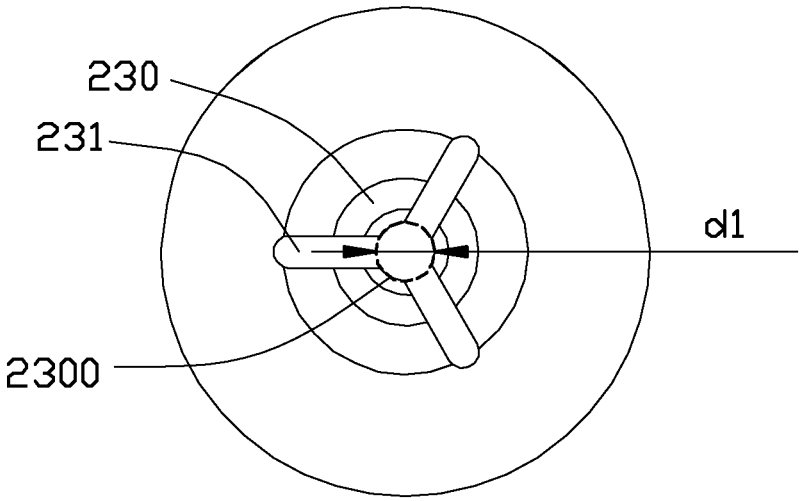
FIG. 4 is a top plane view of the post hole of the electrical connector.
Figure 5:
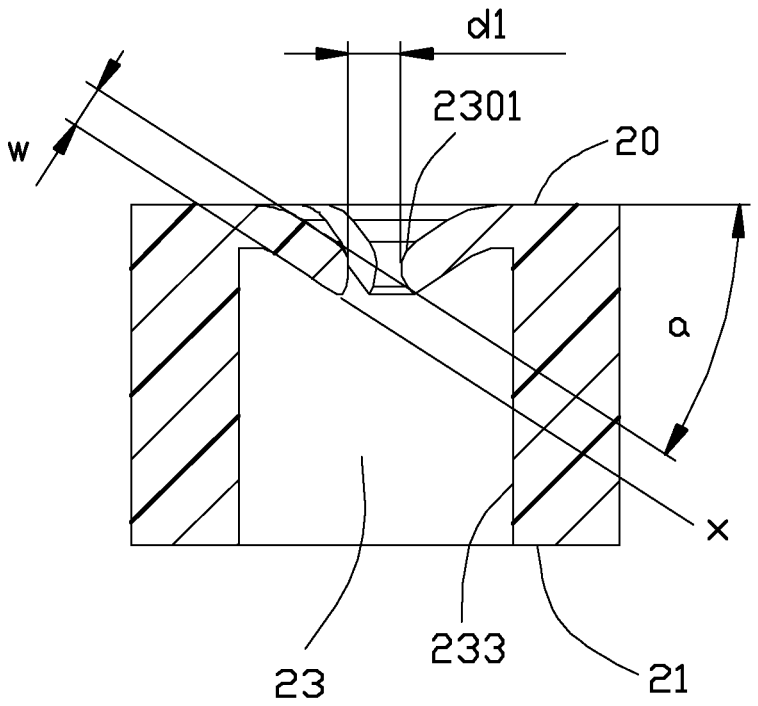
FIG. 5 is a cross sectional view of the post hole of the electrical connector.
Figure 6:
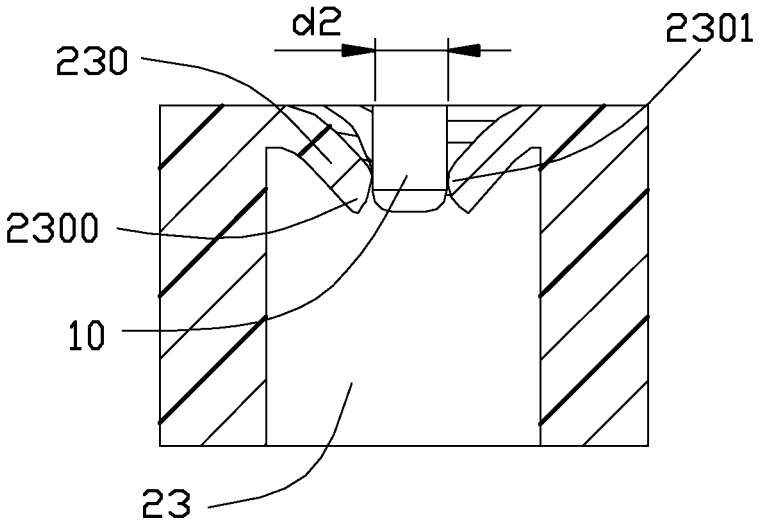
FIG. 6 is a cross sectional view showing the position hole which is inserted with the position post.

Referring to FIGS. 3-6, each of the position holes 23 has three ribs 230 in the inner surface 233 thereof in this embodiment, the ribs extend from the matching surface 20 toward the mounting surface 21. Each of the ribs 230 has a free end 2300 of an arc shape. As best shown in FIG. 4, the arc free ends 2300 of the ribs in one position holes 23 is configured an imagine circle loop, a diameter d1 of the loop is smaller than a diameter of the position hole 23. The diameter d1 of the loop is 0.28 mm. The free end 2300 of the rib 230 has a guide portion 2301 used for guiding the position post 10 into the position hole 23. The ribs 230 are divided into three equal parts in the position hole 23, and arranged intervally by an average distribution and every two adjacent ribs 230 has a gap 231 therebetween. The gaps 231 ensure the ribs 230 with a good elasticity, and it also ensures the circle loop formed by the free ends 2300 of the ribs 230 have a good holding force. The position hole 23 has an empty space below the ribs 230 and the inner surface is smooth, thereby ensuring the ribs 230 having a good elastic force. Each of the ribs 230 is configured with a straight line shape. Each of the ribs 230 and the matching surface 20 define an acute angle a, the acute angle a is 34 degree in this embodiment, the acute angle makes the position post 10 insert into the position hole 23 better. A thickness w of the rib 230 is 0.2 mm, which makes the rib 230 have a good elasticity. Each rib does not arrive a half height of position hole. Each rib 23 defines an image extending line X along an extending direction of the rib 23, the image extending line intersects with the inner surface 233 of the position hole.

The diameter d1 of the loop formed by the ribs 230 of the electrical connector is 0.28 mm, to conform to the development trend of the position post 10 with a smaller size. When the position post 10 is inserted into the position hole 23, the position post 10 has a large intensity of pressure and needs a small insert force, which reduces a damage of the position post 10 and the insulative housing 2. The thickness w of the rib 230 is only 0.2 mm, which is essentially five sevenths of the diameter d1 and enhances the elastic effect. A diameter d2 of the position post 10 is 0.35 mm so the diameter d1 is four fifths of diameter d2 and the thickness w is four sevenths of diameter d2. In this embodiment, the diameter of the position hole 23 is around five times of the diameter d1 of the loop so as to cooperate with the thickness w of the rib 230 and the extending angle a to assure proper rigidity and resiliency of the rib 230 for retaining the inserted position post 10. When the position post 10 is inserted into the position hole 23, the position post 10 will be held better since the ribs 230 has an elastic deformation. Notably, in this embodiment, each rib 230 spans about 105 degrees along a periphery/circumference of the position hole 23.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for electrically connecting a chip module with a position post to a printed circuit board, comprising:

an insulative housing defining a matching surface and a mounting surface confronting with the printed circuit board, and comprising a position hole disposed in the insulative housing; and a plurality of terminals loaded in the insulative housing; wherein the position hole has only three ribs in an inner surface thereof, and the ribs extend from the matching surface toward the mounting surface; wherein the ribs are arranged evenly along a periphery of the position hole; wherein every two adjacent ribs define a gap therebetween.

2. The electrical connector as claimed in claim 1, wherein each of the ribs has an acute angle with the matching surface, the acute angle is between 30-45 degrees.

3. The electrical connector as claimed in claim 2, wherein said acute angle is 34 degrees.

4. The electrical connector as claimed in claim 1, wherein a thickness of each rib is 0.2 mm.

5. The electrical connector as claimed in claim 1, wherein the position hole defined a smooth inner surface below the rib.

6. The electrical connector as claimed in claim 1, wherein free ends of the ribs commonly define an imaginary circle loop with a 0.28 mm diameter which is around four fifths of a diameter of the position post.

7. An electrical connector comprising:

an insulative housing defining a matching surface and a mounting surface opposite each other, and a position hole for retaining a position post;

a plurality of terminals loaded in the insulative housing; wherein the position hole has a plurality of ribs extending from the matching surface into the position hole obliquely and downwardly, and each rib terminates not beyond a half height of the position hole in a vertical direction; wherein the each rib defines an imaginary extending line along an extending direction of the rib, the image extending line intersects with the inner surface of the position hole; wherein the extending direction defines an acute angle, with regard to a mating surface, facing a center axis of the through hole, and said acute angle is within a range between 30-45 degrees; wherein the ribs are divided into three equal parts in the position hole.

8. The electrical connector as claimed in claim 7, wherein free ends of the ribs commonly define an imaginary loop with a diameter, and each of said ribs defines a thickness which is essentially about five sevenths of said diameter.

9. The electrical connector as claimed in claim 8, wherein said diameter is 0.28 mm and the thickness is 0.20 mm.

10. An electrical connector comprising:

an insulative housing defining opposite matching and mounting surfaces;

a position hole extending through said housing in a vertical direction; and a plurality of ribs evenly and unitarily extending from a periphery of said position hole around the matching surface; wherein said ribs commonly defines, in a relaxed manner, an imaginary loop with a diameter, and each ribs defines a thickness which is essentially five sevenths of said diameter; wherein said diameter is around four fifths of another diameter of said position post.

11. The electrical connector as claimed in claim 10, wherein another diameter of the position hole is around five times of the diameter.

12. The electrical connector as claimed in claim 10, wherein each of said ribs extends in a direction with an acute angle with regard to the matching surface and facing to a center axis of the through hole, and said acute angle is within a range between 30-45 degrees.

13. The electrical connector as claimed in claim 12, wherein said acute angle is around 34 degrees, and a thickness of each of the ribs is around 0.20 mm.

14. The electrical connector as claimed in claim 10, wherein an amount of said ribs is three and each of said ribs spanning around 105 degrees with regard to said periphery of said through hole.

* * * * *